US007359844B2

(12) United States Patent
Sung et al.

(10) Patent No.: US 7,359,844 B2
(45) Date of Patent: Apr. 15, 2008

(54) REAL TIME EARTH MODEL FOR COLLABORATIVE GEOSTEERING

(75) Inventors: Roger R. Sung, Dhahran (SA); Kenneth A. Lewis, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 420 days.

(21) Appl. No.: 11/038,376

(22) Filed: Jan. 19, 2005

(65) Prior Publication Data

US 2005/0171698 A1 Aug. 4, 2005

Related U.S. Application Data

(60) Provisional application No. 60/537,595, filed on Jan. 20, 2004.

(51) Int. Cl.
*G06G 7/48* (2006.01)

(52) U.S. Cl. ..... 703/10; 702/9; 702/11; 324/339

(58) Field of Classification Search ..... 703/10; 702/7, 9, 11; 324/303, 339, 347
See application file for complete search history.

(56) References Cited

U.S. PATENT DOCUMENTS

| | | | | |
|---|---|---|---|---|
| 5,442,950 | A | 8/1995 | Unalmiser et al. | |
| 5,995,446 | A | 11/1999 | Meyer et al. | |
| 6,018,497 | A | 1/2000 | Gunasekera | |
| 6,073,079 | A | 6/2000 | Thomas | |
| 6,078,869 | A | 6/2000 | Gunasekera | |
| 6,106,561 | A | 8/2000 | Farmer | |
| 6,400,148 | B1 * | 6/2002 | Meyer et al. | 324/303 |
| 6,442,488 | B2 * | 8/2002 | Xiao et al. | 702/9 |
| 6,466,872 | B1 * | 10/2002 | Kriegshauser et al. | 702/7 |
| 6,553,314 | B2 * | 4/2003 | Kriegshauser et al. | 702/7 |
| 6,950,749 | B2 * | 9/2005 | Frenkel et al. | 702/7 |
| 6,952,101 | B2 * | 10/2005 | Gupta | 324/339 |
| 2003/0093223 | A1 * | 5/2003 | Zhang et al. | 702/7 |

FOREIGN PATENT DOCUMENTS

| | | |
|---|---|---|
| EP | 0 756 181 A2 | 1/1997 |
| GB | 2 327 695 A | 2/1999 |
| WO | WO 00/48022 A1 | 8/2000 |
| WO | WO 01/25823 A1 | 4/2001 |

OTHER PUBLICATIONS

Wilt et al., M. Oil Field Reservoir Characterization and Monitoring Using Electromagnetic Geophysical Techniques, Journal of Petroleum Science and Engineering, vol. 39, Iss. 1-2, Aug. 2003, pp. 85-97.*

Wood, L.J. "The Future of Uncertainly Analysis in Exploration and Production," Univ. of Texas at Austin, AAPG Annual Convention, Salt Lake City, Utah, May 11-14, 2003.

* cited by examiner

*Primary Examiner*—Russell Frejd
(74) *Attorney, Agent, or Firm*—Bracewell & Giuliani LLP

(57) ABSTRACT

An earth model is formed in real time during drilling of a well by incorporating up-to-the-minute knowledge derived from geology, seismic, drilling, and engineering data. The process of forming the model utilizes Logging-While-Drilling (LWD) or Measuring-While-Drilling (MWD) data directly from the drilling rig as the well is drilled. The LWD or MWD data is sent to visualization centers and compared with other data such as existing geological models, the proposed well plan and present interpretation of the subsurface stratigraphy. The results of the comparison enable experts to analyze anomalous results and update the geological model within minutes of penetration of a formation during drilling. Well drilling efficiency is improved, and an "on-the-spot" road map is provided for maximal reservoir contact and pinpoint accuracy.

10 Claims, 7 Drawing Sheets

REAL TIME EARTH MODEL FOR COLLABORATIVE GEOSTEERING

RELATED APPLICATIONS

This Application claims the benefit of U.S. Provisional Patent Application Ser. No. 60/537,595 filed Jan. 20, 2004.

BACKGROUND OF THE INVENTION

1. Field of the Invention

The invention herein relates to forming models of subsurface earth formations based on data obtained from wells being drilled in those formations.

2. Description of the Related Art

With increased competition in the energy market, oil companies face a daunting task of improving accuracy while reducing cycle time. Technologies in horizontal drilling, real time monitoring, and reservoir modeling have advanced significantly during the last few years. There are still, however, conceptual gaps in knowledge of the actual subsurface structure in well plans by geoscientists and engineers for a well to be drilled.

Typically, the well plan is an earth model based on best available information from surveys, well logs and other reservoir techniques. The interest is to locate a well at particular locations in a formation of interest for optimum production. A considerable number of wells currently being drilled are drilled horizontally through a formation or reservoir of hydrocarbon interest. The objective in such a well is for the well base to have a suitable length or exposure of extent, usually expressed in terms of reservoir feet, in the formation.

In the event that the actual subsurface formations or stratigraphy differ from the well plan, the well bore may be located in the reservoir at a position where less reservoir feet of extent in the reservoir are obtained than were planned. In some instances, even with sophisticated well plans, the actual subsurface formation may differ sufficiently from the plan model so that the well bore does not contact the reservoir of interest for any significant extent.

There have been techniques for forming revised or updated models based on well data. However, so far as is known, conventional techniques to form revised or updated models have taken days or weeks. Thus, the revised data or well model was not available until long after drilling operations had passed the proper location for corrections to be made in steering of the drill bit to better locate the well in the reservoir of interest.

SUMMARY OF INVENTION

Briefly, the present invention provides an earth model incorporating up-to-the-minute knowledge derived from geology, seismic, drilling, and engineering data. The present invention utilizes Logging-While-Drilling (LWD) or Measuring-While-Drilling (MWD) data directly from the drilling rig as a well is being drilled.

An earth model is formed in real time during drilling of a well by incorporating up-to-the-minute knowledge derived from geology, seismic, drilling, and engineering data. Logging-While-Drilling (LWD) or Measuring-While-Drilling (MWD) data are directly from the drilling rig as the well is drilled. The LWD or MWD data are sent to visualization centers and compared with other data such as existing geological models, the proposed well plan and present interpretation of the subsurface stratigraphy. When the real time data from the well indicates a different stratigraphy than the well model, revised models are formed based on the newly acquired well data. The present invention thus enables experts to analyze unexpected results and update the geological model within minutes of penetration of a formation during drilling. Well drilling efficiency is improved in real time, and an "on-the-spot" road map is provided to steer the drill bit based on the newly developed map for maximal reservoir contact and drilling accuracy.

To better understand the characteristics of the invention, the description herein is attached, as an integral part of the same, with drawings to illustrate, but not limited to that, described as follows.

BRIEF DESCRIPTION OF THE DRAWINGS

A better understanding of the present invention can be obtained when the detailed description set forth below is reviewed in conjunction with the accompanying drawings, in which.

Figure 1:
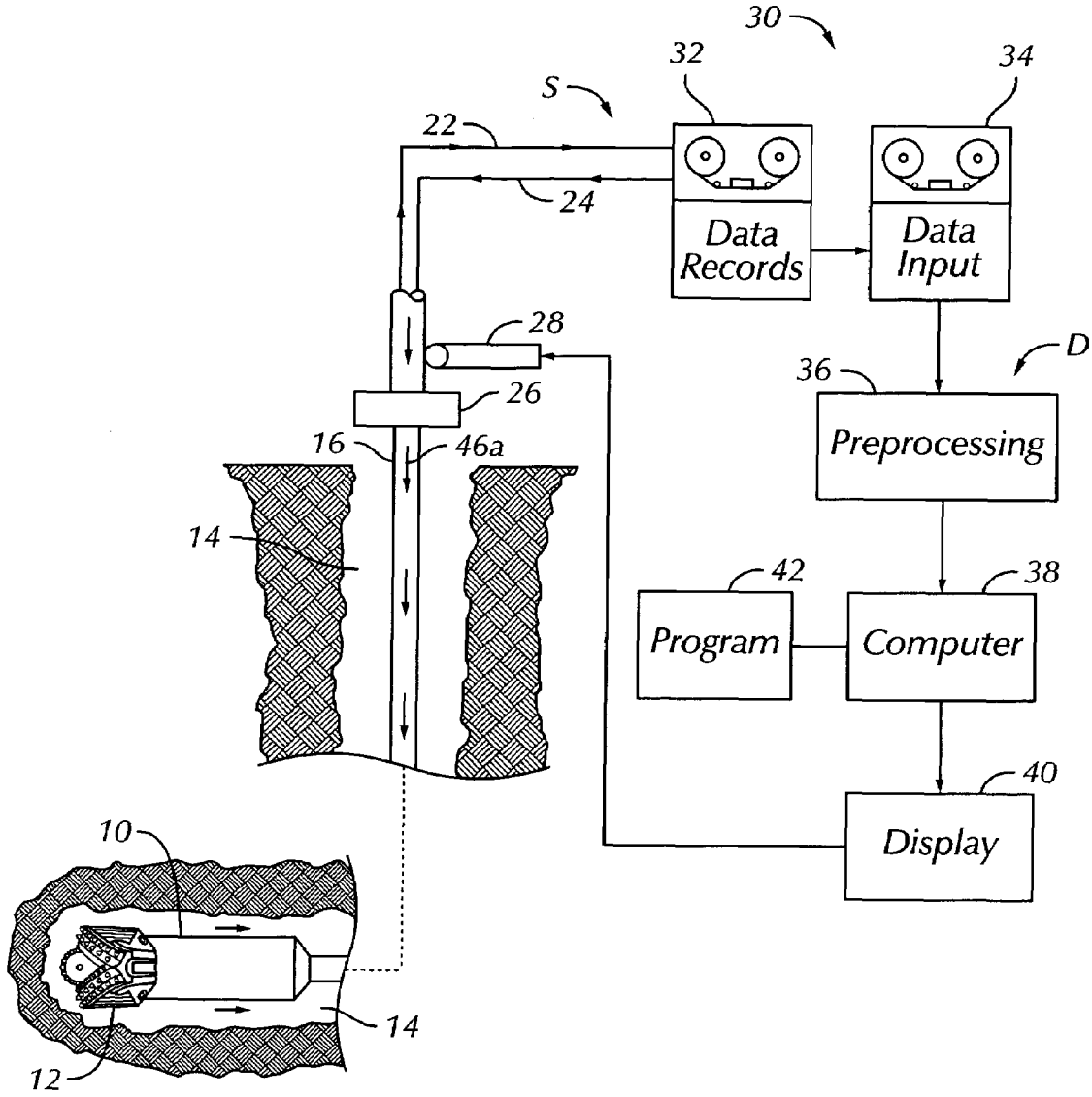
FIG. 1 is a schematic diagram, taken partly in cross-section, of an illustrative example of a conventional prior art well measuring while drilling system for gathering data to be processed.

To better understand the invention, we shall carry out the detailed description of some of the modalities of the same, shown in the drawings with illustrative but not limited purposes, attached to the description herein.

DETAILED DESCRIPTION OF THE PREFERRED EMBODIMENTS

In the drawings, FIG. 1 illustrates an example of a prior art measurement-while-drilling (MWD) system S for gathering data about subsurface formations during drilling. The system S may be one of several commercially available types used during drilling operations at a wellsite to gather data. Once the data has been obtained, it is then available for processing in a manner to be set forth according to the present invention. The system S includes as a part of the drilling rig a downhole subassembly 10 that moves within a borehole 14 behind a drill bit 12 at a lower end of a drill string 16 during drilling of the borehole 14. As shown in FIG. 1, the drill bit 12 and the borehole 14 have transitioned from an initial vertical direction to a generally horizontal path into subsurface earth formations 18. The downhole subassembly 10 is preferably positioned as close as practical to the drill bit 12.

The drill bit 12 may be rotated in several ways during drilling operations. The drill bit 12 may be rotated by a downhole motor which may be contained in a downhole subassembly 10. The drill bit 12 may also be driven by rotating the drill string 16 by a surface prime mover 26 to drill the borehole 14 in the earth formations 18. For simplicity, the prime mover and other components of the surface drilling rig are not shown. The downhole assembly 10 contains various sensors and devices of the conventional type for gathering data during drilling operations. If desired, a conventional logging-while-drilling or LWD system may be used in place of the MWD system 10.

Data from the downhole subassembly 10 are telemetered by a downhole telemetry system (not shown) in the downhole subassembly 10 to an uphole telemetry and data processing system D. The uplink data telemetry path is indicated by a phantom or broken line 22. Data from the downhole subassembly 10 are received by the uphole telemetry and data processing system D and recorded in a suitable data memory 30 including a data records unit 32 and a data input unit 34 as functions of borehole depth.

A preprocessing unit 36 and a processor computer 38 receive and process the data of interest such that the parameters of interest are recorded and displayed in the desired manner which is usually a plot of the parameters of interest as a function of depth within the borehole at which they are determined. The telemetry system utilized in the present invention may be of several conventional, commercially available types, including either MWD or LWD well telemetry systems. It should also be understood that there are several commercially available well telemetry systems which are capable of providing well data about formation parameters of interest derived from well drilling as the well is being drilled that may be used for gathering data. Once the data are gathered, they are available for processing according to the present invention.

The preprocessing unit 36 and processor computer 38 also receive input data from the data memory input element 34 which are telemetered downhole by a downlink telemetry path denoted by the broken line 24 to the downhole subassembly 10. The use of a two-way communication system is especially useful in changing reference data such as offset well data or even sensor response model data during the actual drilling operation. The system 10 also includes a surface depth measurement system, such as a depth measure wheel and associated circuitry 28. A depth measurement system (not shown) also is typically included in the downhole subassembly 10 which enable a downhole computer to more accurately correlate or compute various sensor measurements and parameters of interest to their respective depths or true locations within the borehole 14 at which such measurements are made.

The MWD data from the downhole subassembly 10 are recorded as functions of borehole depth in the data memory 30. Once recorded, the MWD data measurements are transferred as needed into the preprocessing unit 36 and processor computer 38 of the system D. The MWD data measurements are subjected to conventional preprocessing in the preprocessing unit 36 and then transferred to a computer 38. The processed data measurements in computer 38 are then available for processing according to the present invention in a manner to be set forth below.

The processed MWD data measurement obtained while drilling may, if desired, be transmitted by satellite or other suitable telemetry link for processing according to the present invention by a computer located at an office or other facility which is considerably distant from the area of the well being drilled or logged. The processed MWD data results may also be processed according to the present invention in the computer 38 at the drilling site. The results from processing, whether at a distant computer or at the computer 38, are then available in real time during well operations for analysis on a suitable display or plotter, such as plotter 40 at the well site. Processed results obtained by telemetry at computers spaced from the well site are also available during real time on suitable displays and plotters.

The computer at the office located away from the well can be a mainframe computer of any conventional type of suitable processing capacity such as those available from International Business Machines (IBM) of Armonk, N.Y. or other source. Other digital processors, however, may be used, such as a laptop computer, or any other suitable processing apparatus both at the well site and the central office.

In any case, the processor of the computer 38 at the well site, or the computer at the other office, accesses the MWD data measurements to undertake the logic of the present invention, which may be executed by a processor as a series of computer-executable instructions. The instructions may be contained on a data storage device 42 with a computer readable medium, such as a computer diskette shown in FIG. 1 having a computer usable medium stored thereon. Or, the instructions may be stored in memory of the computer 38, or on magnetic tape, conventional hard disk drive, electronic read-only memory, optical storage device, or other appropriate data storage device.

Figure 2:
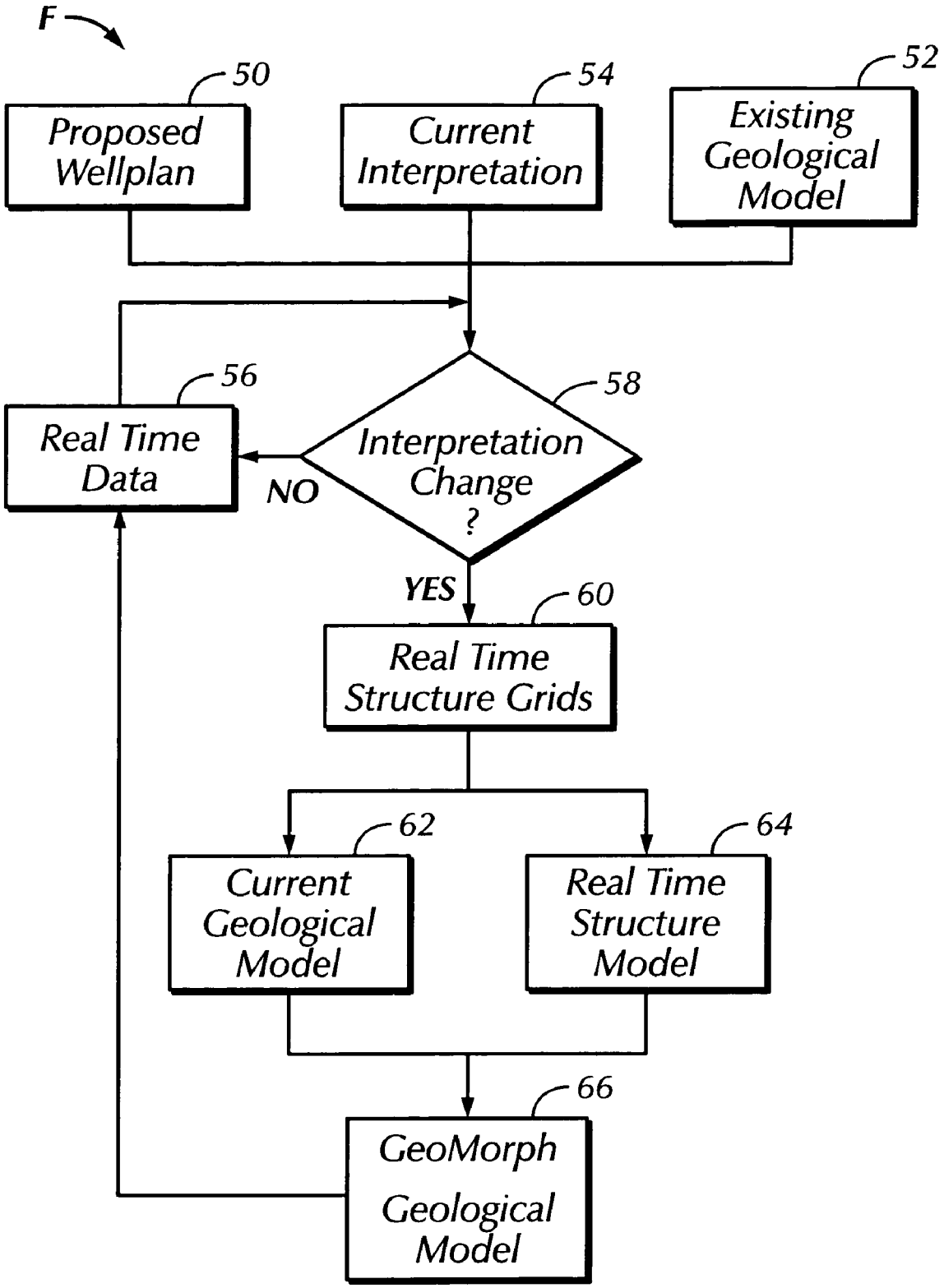
FIG. 2 is a block diagram of data processing steps according to the present invention.

A flow chart F of FIG. 2 herein illustrates the structure of the logic of the present invention as embodied in computer program software. Those skilled in the art will appreciate that the flow charts illustrate the structures of computer program code elements that function according to this invention. Manifestly, the invention is practiced in its essential embodiment by a machine component that renders the program code elements in a form that instructs a digital processing apparatus (that is, a computer) to perform a sequence of function steps corresponding to those shown.

It is important to note that, while the present invention has been, and will continue to be, described in the context of a fully functional computer system, those skilled in the art will appreciate that the present invention is capable of being distributed as a program product in a variety of forms, and that the present invention applies equally regardless of the particular type of signal-bearing media utilized to actually carry out the distribution. Examples of signal-bearing media include: recordable-type media, such as floppy disks, hard disk drives, and CD ROMs, and transmission-type media such as digital and analog communication links.

With reference to FIG. 2, there is depicted a high-level logic flowchart illustrating a method according to the present invention of forming models of subsurface earth formations through which well drilling operations are proceeding in a well bore. The method of the present invention performed in the computer 38 can be implemented utilizing the computer program steps of FIG. 6 stored in memory 42 and executable by system processor of computer 38 and also the data resulting from the other steps of FIG. 2 not implemented by the computer 38. Such data is furnished to computer 38 through any suitable form of computer data input device.

As shown in the flow chart F, several existing estimates of the subsurface formations and their location, in the form of one or more of: proposed well plan data 50, existing geological model data 52 and a current interpretation 54 of the well being drilled are available for comparison and use during according to the present invention.

The proposed well plan data 50 represents a planned or estimated well trajectory through subsurface earth formations in three-dimensional space before drilling of the well in question actually begins. The existing geological model data 52 is continually updated during the process of the present invention. The existing geological model data 52 contains at any time during processing according to the present invention the most recent three-dimensional model of geological attributes processing results at the present moment in time during a drilling operation. The current interpretation data 54 is also continuously updated during the process of the present invention. The current interpretation data 54, at any time during the process of the present invention, contains the most recent geological and geophysical interpretation at that time of a subsurface reservoir of interest.

The existing estimates are stored in either the data records 32 or other suitable data memory associated with the computer 38. Real time telemetry data from in the form of logging data (such as one or more of gamma ray, ROP or resistivity logs) obtained while drilling from the downhole assembly 10 are obtained. The real time telemetry data are available in real time as indicated at 56 after suitable processing according to the process steps depicted schematically in the flow chart F. As previously noted, such processing may occur well after transmission from the well to a central processing facility, or in the computer 38.

As indicated at step 58 in flow chart F, the real time data 56 are compared in real time (as the well is being drilled) with one or more sets of existing element data 50, 52 and 54. The comparison is performed to see if one or more geological indications of interest might differ from some indicator, measurement or parameter of the existing estimates stored as data as indicated at 50, 52 and 54, or from some earlier measurement or indication. For example, a geological markers interpretation based on real time well logs from the system S might indicate that a reservoir boundary is either shallower or deeper than a previous estimate.

It is thus important to note that the process of the present invention incorporates real time logging-while-drilling data and real time structure interpretation into the comparison process. In the event that the results of the comparison step 58 indicate no significant variation or difference in the real-time telemetry data from the well bore and the existing estimates, the process of the present invention updates the current interpretation data 54. Processing according to the present invention then continues sampling with the telemetry data from the downhole subassembly 10 as drilling progresses. As new data are obtained, they are processed in the foregoing manner and subjected to the comparison step 58.

In the event, however, that the results of comparison step 58 indicate that there is a difference sufficient in magnitude or effect between the well being drilled and the existing estimates, the process of the present invention proceeds to generate or morph a new geological model of the well according to the latest understanding obtained from the well telemetry. If the real time data indicates a different scenario from the current model, then a new interpretation and structure grids are generated or morphed during a process step 60.

Thus, once a geological marker interpretation changes, those changes are incorporated into the data. The structure grids are in effect re-gridded in real time to provide up-to-date structure grids. As a result of step 60, the structure grids which make up the stratigraphic framework in the existing geological model 52 are no longer current. During step 62, the newly updated structure grids are exchanged and substituted in place of those previously in the existing geological model 52. The old grids are thus exchanged and replaced by the updated grids. However, the original geological relationship established at the outset is maintained. This is done while allowing a new model as indicated at step 66 to be made based on the updated structure grids.

Usually when a new stratigraphic framework is formed, existing reservoir attributes are erased or deleted. With the present invention, those files which contain the existing reservoir attributes are retained and migrated into their revised or updated locations during the step 66. The results of step 66 are then stored and retained as the current interpretation 54. The previously calculated reservoir attributes are thus migrated in real time to their spatially up-to-date locations. A new real-time structure model of the well is thus generated as the well is being drilled.

An important feature of the present invention is the speed at which the decision-making process and new model generating or morphing takes place. According to the present invention, it is possible to generate or morph a revised geological model in minutes based on the real-time telemetry data.

The methodology of morphing or forming a new model according to the present invention occurs during a process step 66. Processing during step 66 has two processing phases: a stratigraphic framework phase; and a reservoir attributes migration phase, and a display phase.

Processing during step 66 assumes the uncertainty of the reservoir of interest for the well in progress lies mostly on the absolute location of the layers in the subsurface formation stratigraphy. The relative stratigraphic positions tend not to vary drastically within the length of a well bore. Generally, a 100% structurally up-to-date and 90+% stratigraphically sound continuity may be applied to most carbonate reservoirs. The reservoir attributes migration phase of step 66 morphs the attributes from the current geological model into the real-time structure model to obtain an updated model according to the present invention. Also during step 66, the display 40 is provided with the processing results to form output displays of the types shown in FIGS. 3-8. The processed results are also used, as has been previously mentioned, to update either or both of the current interpretation data 52 and the geological model 54.

Figure 3:
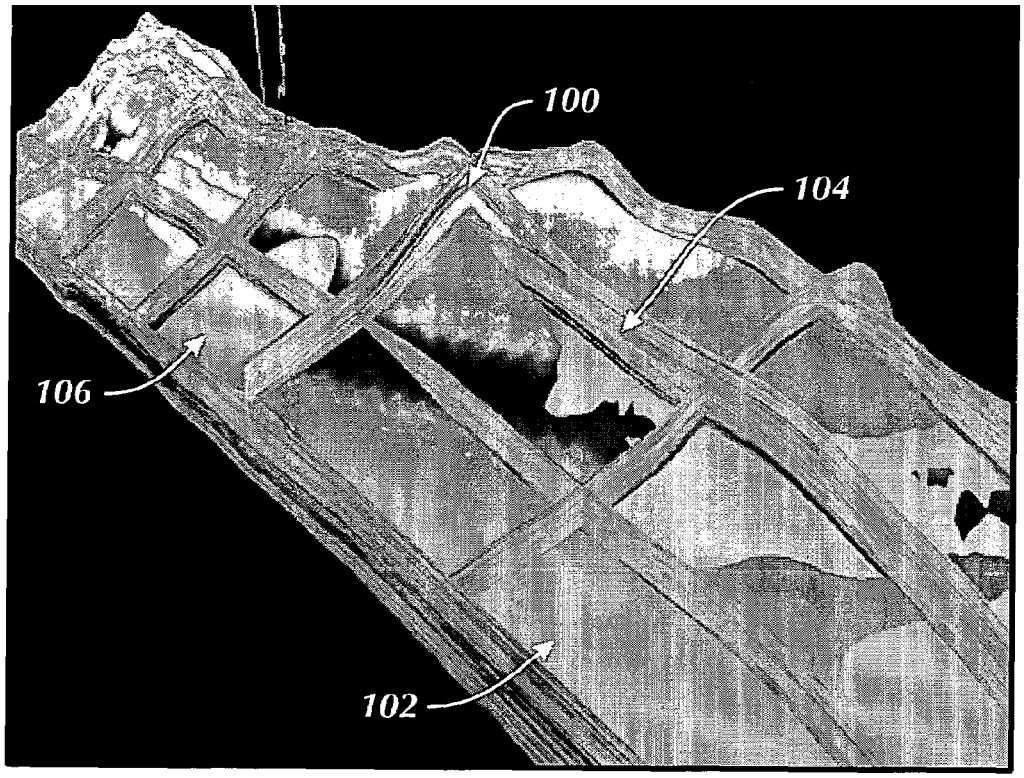
FIG. 3 is an example plot of data formed according to the present invention showing process results in the form of an updated model of formation stratigraphy.

FIG. 3 is an example display of stratigraphic data illustrating by way of comparison a cross-section from an original model at 100 and an original stratigraphic slice at 102. FIG. 3 also contains at 104 a new model cross-section and a stratigraphic slice 106 at a new location based on data processed from MWD data obtained according to the present invention.

Figure 4:
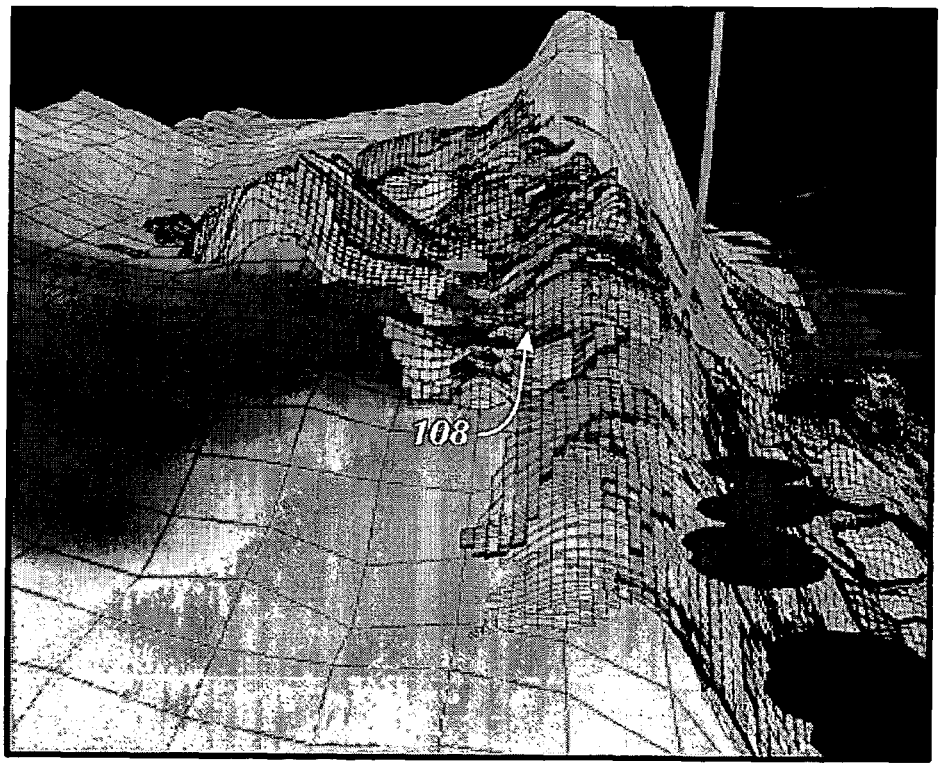
FIG. 4 is an example plot of a three-dimensional model of a subsurface tar mat or body in a field containing hydrocarbon production reserves.

FIG. 4 is a display of a three-dimensional model of data from the same area as FIG. 3, and formed by conventional techniques in a computer. As can be seen, FIG. 4 shows a significant tar mat 108 known to be present in a field containing significant hydrocarbon reserves. This large and complicated tar body 108 has impeded a pressure difference (over 1000 psi) which has been built up by a ring of injector wells on one side of the mat to support oil production wells on an opposite side of the tar mat. A tunnel well with a mother bore and two laterals were planned to drill across the tar mat to provide the much needed reservoir pressure support. The techniques of the present invention were important to the successful drilling of the multi-lateral well.

As will be discussed below, the existing structural grids in the area of body 108 were updated using the latest well control and these grids were then utilized to "morph" the tar, porosity and permeability attributes to fit the current structural interpretation. This allowed for extremely accurate well planning of the mother bore and both laterals across the tar mat. This accuracy was required to ensure that the cased "heel" section of the horizontal well was placed in the "tar-free" area or the injector well side of the tar mat and the "toes" of all three horizontals placed also in the "tar-free" area on the opposite of the tar mat from the injector wells. Upon perforation the fluids were to flow from the high-pressure injector well side to the low-pressure opposite side oil producers.

Figure 5:
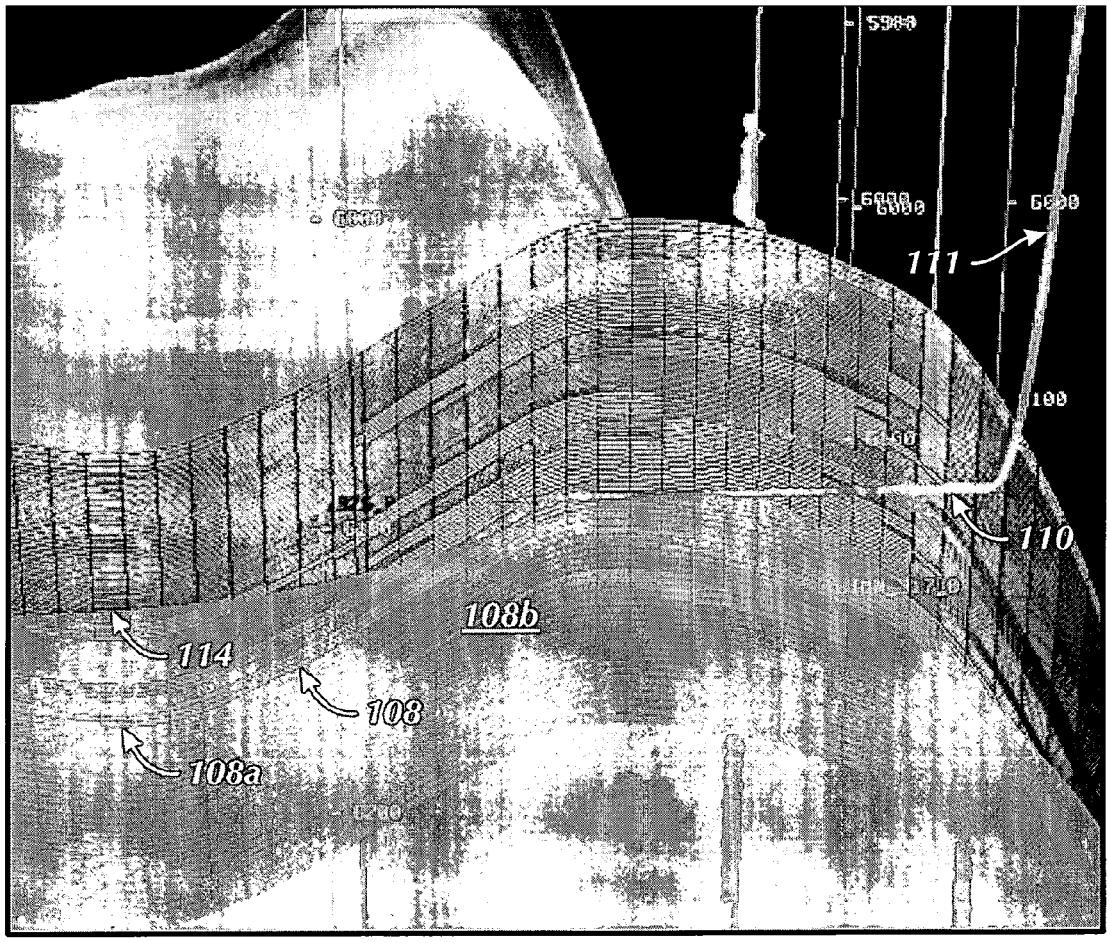
FIGS. 5 and 6 are example plots formed according to the present invention of subsurface formations and the location of a well bore in the area of the tar body shown in the model of FIG. 4.

FIG. 5 is an example vertical cross-section plot of a subsurface structure in the same area as FIGS. 3 and 4, showing a wellbore at 110 from a mother bore 111 to be drilled horizontally out of the tar barrier or mat 108. A semi-transparent surface 114 is the current real time interpretation of the structure formed according to the present invention. The tar geobody 108 extends in the display of FIG. 5 from a lower area 108*a* to an upper area 108*b*, and is based on an old interpretation. As can be seen, the location of tar 108 does not conform with the real time interpretation 114. The tar 108 is shown in the display of FIG. 5 to be a lot deeper than the real-time interpretation 114.

Figure 6:
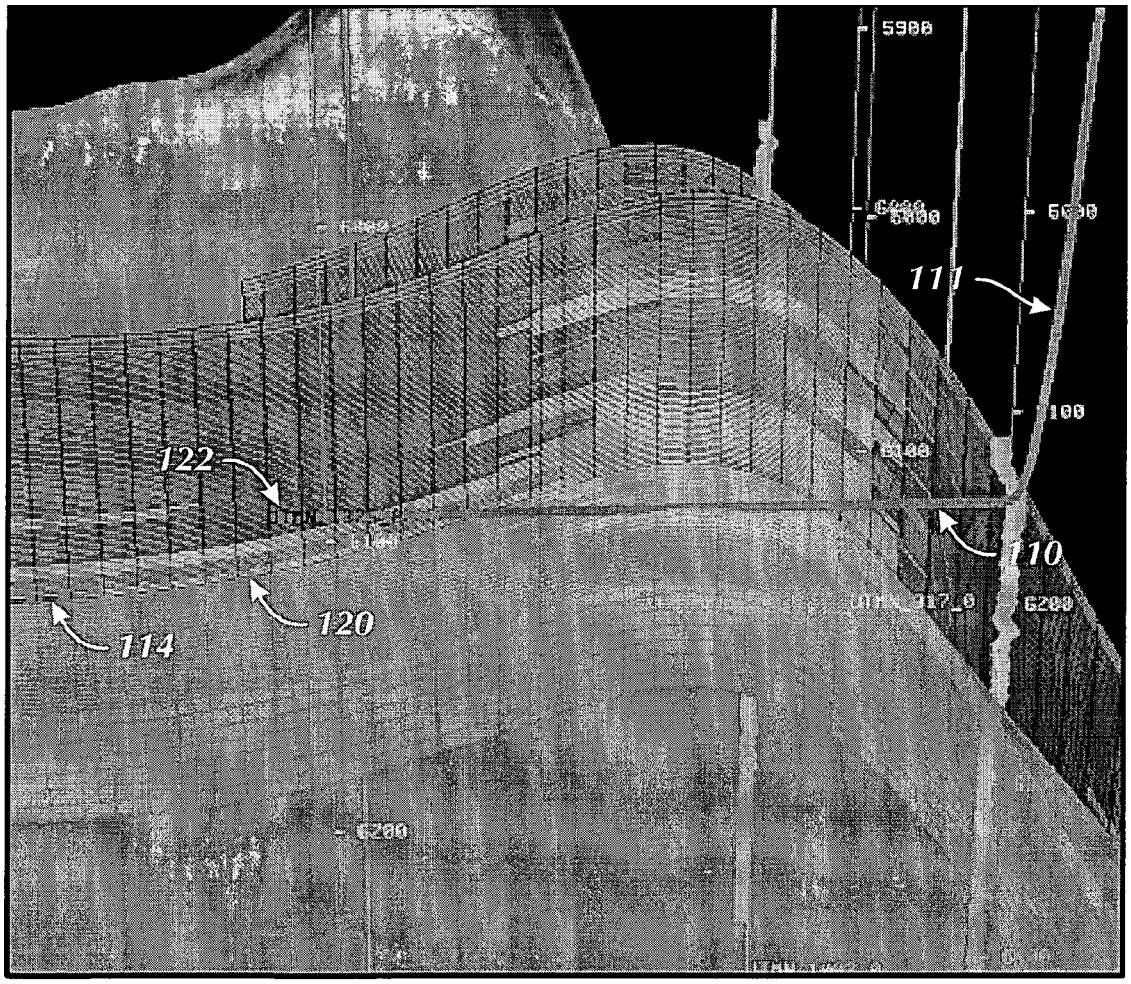

In FIG. 6, an area 120 indicates a revised location formed according to the present invention of the tar geobody shown at 108 in FIGS. 4 and 5. It is to be noted that the tar body 120 has been pulled up structurally and now is conforming with the current structure grid 114 shown in both FIGS. 5 and 6. Further, as indicated at 122, the well bore 110 has drilled out of the up-to-date location of tar barrier 120 provided by the present-invention to meet the well drilling objective of drilling for reservoir pressure support, as previously mentioned.

Figure 7:
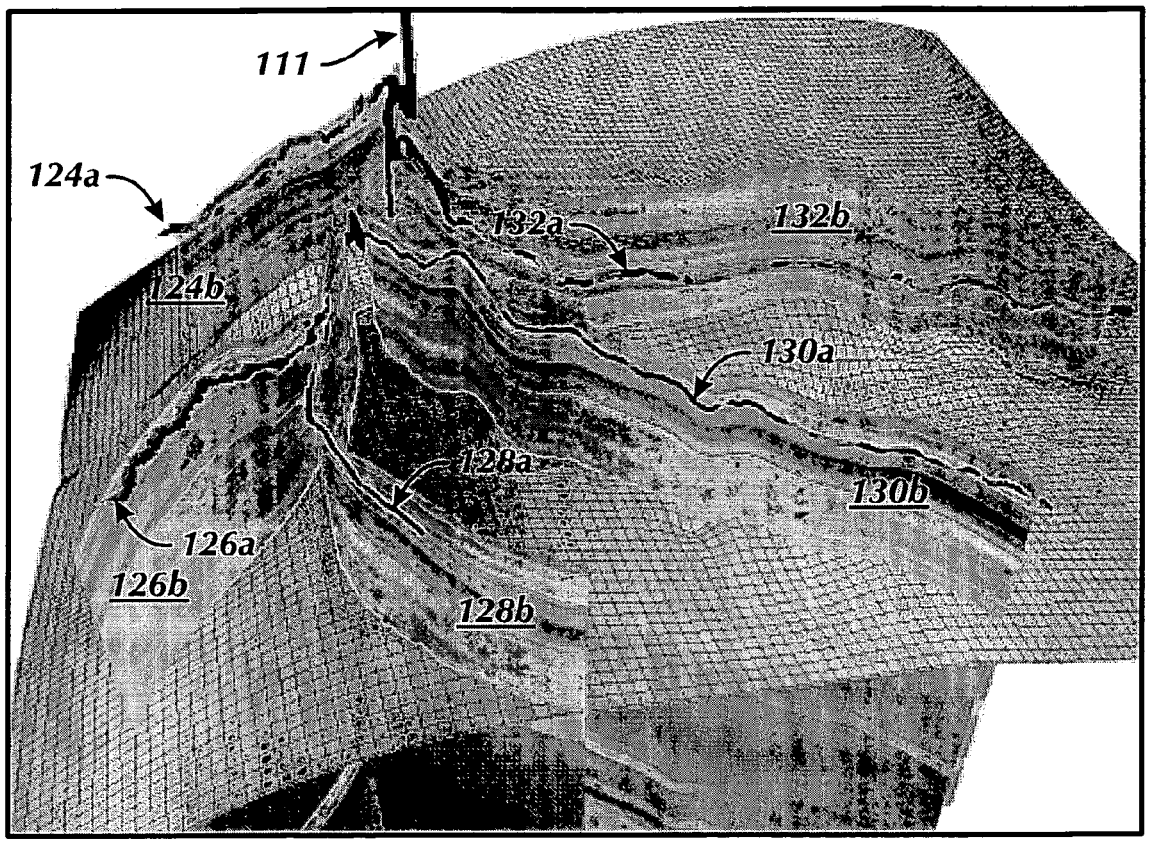
FIG. 7 is another example plot of formation stratigraphy formed according to the present invention.

FIG. 7 is another example of formation stratigraphy formed according to the present invention from data in the field from which the displays of FIGS. 3, 4, 5 and 6 were formed. In FIG. 7, the trajectories of five highly complicated and long-reaching lateral wells or laterals 124*a*, 126*a*, 128*a*, 130*a* and 132*a* of a well originating from the mother bore 111 are shown. Also shown in FIG. 7 along each of the lateral wells is a vertical model 124*b*, 126*b*, 128*b*, 130*b* and 132*b*, respectively, formed according to the present invention, displaying an attribute of interest, such as porosity, for the various formations along the path of such lateral wells. The present invention thus provides real time displays of attributes along the paths of the various lateral wells. Up-to-date displays of an attribute (e.g. porosity) according to the present invention guide the drill bit to reach best reservoir rock.

Figure 8:
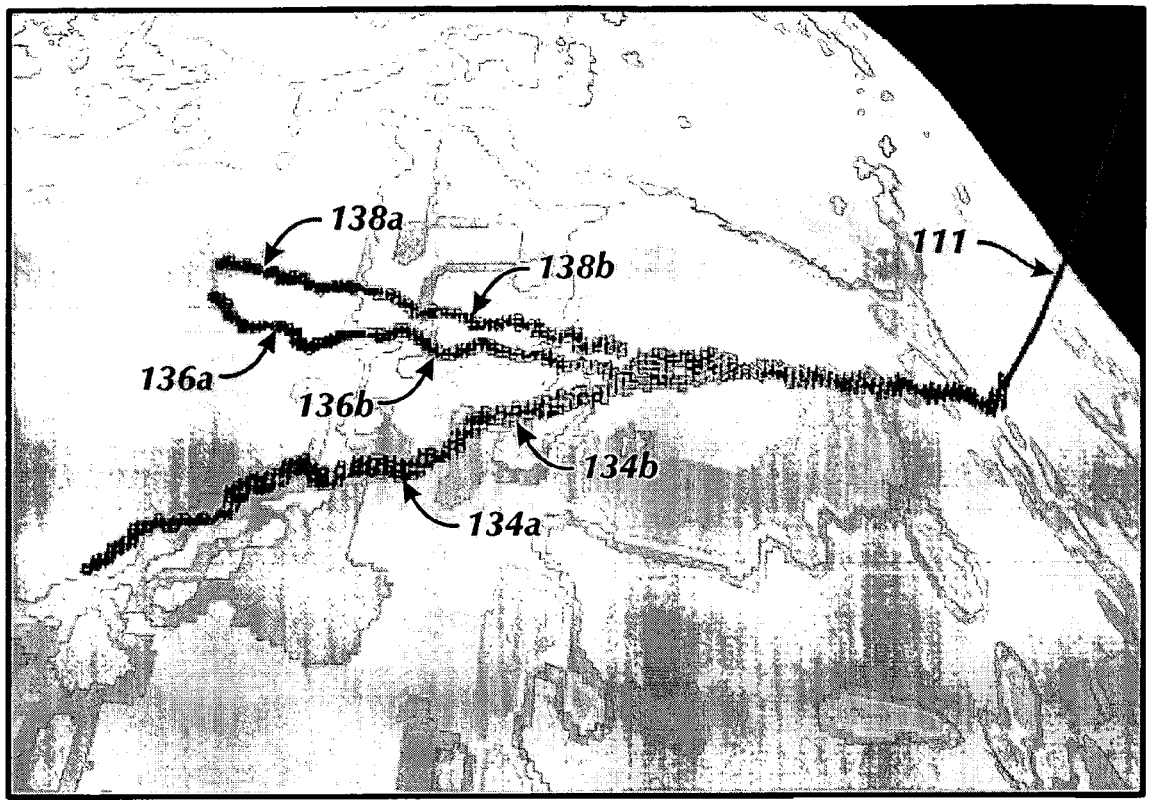
FIG. 8 is another example plot of data results obtained according to the present invention.

FIG. 8 is another example of three lateral wells 134*a*, 136*a* and 138*a* from the well bore 111 formed utilizing the present invention from data in the same area discussed above. Reference numerals 134*b*, 136*b* and 138*b* indicate the formation attributes along the paths of the respective wellbores, 134*a*, 136*a* and 138*a*. These on-the-spot attributes can be compared and calibrated exactly with real time data 56.

Figure 9:
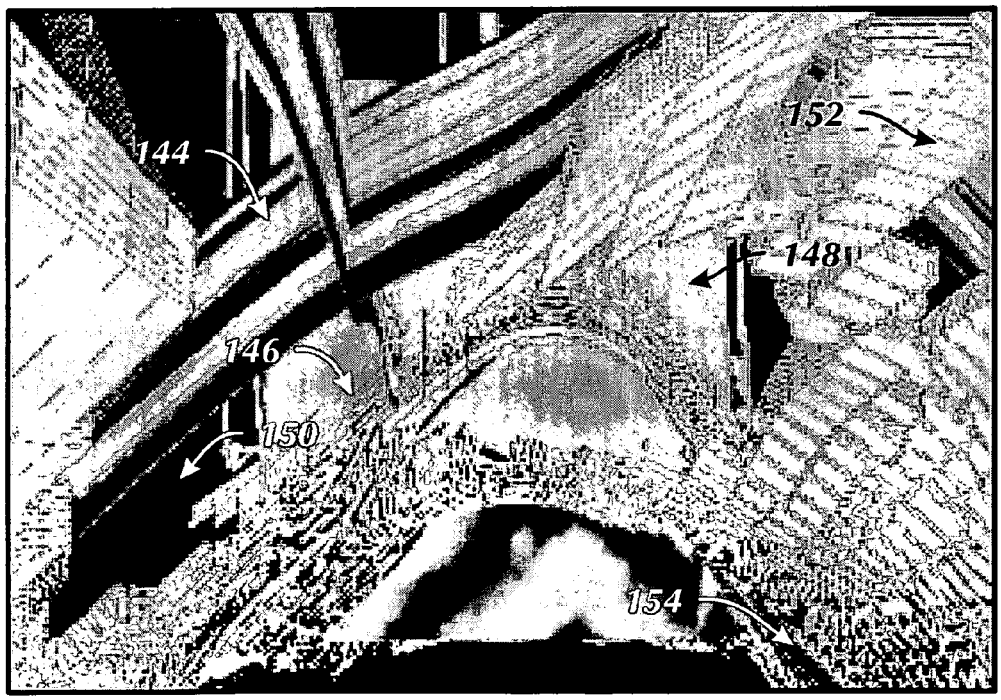
FIG. 9 is another example result of formation stratigraphy formed according to the present invention.

FIG. 9 is another example data display of results obtained according to the present invention at a location from an existing geological model. An area 144 displays permeability as obtained from the existing geological model 62. An area 146 displays oil saturation obtained from the simulation model, and an area 148 is a display of interval velocity obtained from seismic data in the existing geological model 62. Reference numeral 150 designates the current-drilling wellbore, and a tar geobody is indicated at 152. As discussed above, the objective of drilling the well 150 is to stay away from the tar 152 (a non-reservoir feature). Therefore, accurately knowing during drilling where the tar 152 is located proves to be a key factor on the well success. Area 154 in FIG. 9 is the location of tar body after data processing according to the present invention. It can be seen that the present invention provides a real time road map for drilling to avoid undesirable obstacles in the earth formation, or to steer an optimum path in or through them.

The speed at which the processing occurs is an important factor for the model update in order to guide expensive geosteering and drilling. Conventional methods take a much longer time when a drill bit has passed the position indicated by the geological model. A conventional update according to methods presently known to applicants typically takes a long time (e.g., days or weeks). As a result, the drill bit has moved significantly away from the reservoir of interest before this fact could be determined. Drilling operations are expensive, and unnecessary drilling makes drilling more expensive. Due to the lack of adequate or accurate data from prior processes, guiding of the drill bit window was done in the absence of accurate information about the drill bit location with respect to the formation of interest.

With the present invention, it is thus possible to plan, drill and control in real-time or geosteer a well during drilling at thousands of feet below the earth's surface. As the well is being drilled and new data about drilling progress is learned along the way in real-time, the new interpretations are incorporated into the earth model to guide the continuous drilling. As has been mentioned, conventional methods take significant time to update the model as compared to the drilling speed. The end result of conventional methods is that of multi-million dollar costs for a well being drilled and based on decisions obtained from use of an outdated model or data.

The process of the present invention provides a real-time earth model to quantitatively not qualitatively, guide and control the geosteering or drilling operations. The present invention thus provides a real time earth model, which greatly enhances reservoir geologists' ability to accurately visualize, predict, geosteer, and monitor the placement of wells.

The invention has been sufficiently described so that a person with average knowledge in the matter may reproduce and obtain the results mentioned in the invention herein Nonetheless, any skilled person in the field of technique, subject of the invention herein, may carry out modifications not described in the request herein, to apply these modifications to a determined structure, or in the manufacturing process of the same, requires the claimed matter in the following claims; such structures shall be covered within the scope of the invention.

It should be noted and understood that there can be improvements and modifications made of the present invention described in detail above without departing from the spirit or scope of the invention as set forth in the accompanying claims.

What is claimed is:

1. A method of forming a model of subsurface earth formations as well drilling operations are proceeding through a wellbore in the formations based on real time formation telemetry data sensed with a well drilling tool in the wellbore, comprising the steps of:

storing in a computer memory existing models of the subsurface formations of interest and the stratigraphic locations of the formations of interest;

receiving real time formation telemetry data measurements from the well drilling tool;

forming estimates in the computer of formation geologic attributes at the location of the well drilling tool in the wellbore from the real time formation telemetry data while well drilling is proceeding in the wellbore;

comparing the computer estimates of formation geological attributes at the location of the well drilling tool in the wellbore with at least one of the stored existing models of the subsurface formations to determine if a geologic indication of interest and the location thereof in the formations differs from the at least one of the stored existing models;

if the geologic indication of interest differs from the at least one of the stored existing models with which it is compared, generating a new model of the well based on the received real time formation telemetry data by performing the steps of updating the structure grids of the formation of interest and substituting the updated structure grids for the structure grids of an existing stored geologic model; and providing a visible display of the generated new model of the well to guide the drilling operation.

2. The method of claim 1, wherein the stored existing models include a proposed well trajectory through the formations of interest.

3. The method of claim 1, wherein the step of generating a new model includes the steps of generating new reservoir attributes for the formation of interest at the location of the substituted updated structure grids.

4. The method of claim 3, further including the step of:

storing the new generated reservoir attributes for the substituted updated structure grids in the stored existing models.

5. The method of claim 4, further including the step of:

to retaining the existing formation geologic attributes for the substituted updated structure grids in the stored existing models.

6. The method of claim 3, further including the step of migrating the existing formation geologic attributes into the updated structure grids.

7. A data processing system for forming a model of subsurface earth formations as well drilling operations are proceeding through a welibore in the formations based on real time formation telemetry data sensed with a well drilling tool in the welibore, the data processing system comprising:

a computer memory;

a processor performing the steps of:

storing in the computer memory existing models of the subsurface formations of interest and the stratigraphic locations of the formations of interest;

receiving real time formation telemetry data measurements from the well drilling tool about formation geologic attributes at the location of the well drilling tool in the wellbore while well drilling is proceeding in the wellbore;

comparing the received well logging telemetry data drilling tool about formation geologic attributes at the location of the well drilling tool in the wellbore with at least one of the stored existing models to determine if a geologic indication of interest and the location thereof in the formations differs from the at least one of the stored existing models if the geologic indication of interest differs from the at least one of the stored existing models with which it is compared, generating a new model of the well based on the received real time formation telemetry data by performing the steps of updating structure grids of the formation of interest and substituting the updated structure grids for the structure grids of an existing stored geologic model; and a data output display for providing a visible display of the generated new model of the well to guide the drilling operation.

8. A computer program product stored in tangible, recordable-type machine readable signal bearing media for causing a data processor to form a model of subsurface earth formations through which well drilling is proceeding in a wellbore in the formations, the computer program product containing in the tangible, recordable-type machine readable signal bearing media instructions stored in machine-readable code and causing the processor to perform the following steps:

storing in a computer memory existing models of the subsurface formations of interest and the stratigraphic locations of the formations of interest;

receiving real time formation telemetry data measurements from the well drilling tool about formation geologic attributes at the location of the well drilling tool in the wellbore while well drilling is proceeding in the wellbore;

comparing the received real time formation telemetry data measurements of formation geologic attributes at the stratigraphic location of interest with at least one of the stored existing models to determine if a geologic indication of interest and the location thereof in the formations differs from the at least one of the stored existing models if the geologic indication of interest differs, generating a new model of the well based on the received real time formation telemetry data by performing the steps of updating the structure grids of the formation of interest and substituting the updated structure grids for the structure grids of an existing geologic model stored as an existing model; and providing a visible display of the generated new model of the well to guide the drilling operation.

9. A method of forming a model of subsurface earth formations as well drilling operations are proceeding through a wellbore in the formations based on real time formation telemetry data sensed with a well drilling tool in the wellbore, comprising the steps of:

storing in a computer memory existing models of the subsurface formations of interest and the stratigraphic locations of the formations of interest;

receiving real time formation telemetry data measurements from the well drilling tool;

forming estimates in the computer of formation geologic attributes at the location of the well drilling tool in the wellbore from the real time formation telemetry data while well drilling is proceeding in the wellbore;

comparing the computer estimates of formation geological attributes at the location of the well drilling tool in the wellbore with at least one of the stored existing models of the subsurface formations to determine if a geologic indication of interest and the location thereof in the formations differs from the at least one of the stored existing models;

if the geologic indication of interest differs from the at least one of the stored existing models with which it is compared, generating a new model of the well based on the received real time formation telemetry data by performing the steps of updating structure grids of the formation of interest and substituting the updated structure grids for the structure grids of an existing stored geologic model;

storing the generated new model of the well for the substituted updated structure grids in the stored existing models; and providing a visible display of the generated new model of the well to guide the drilling operation.

10. The method of claim 9, further including the step of:

retaining the existing formation geologic attributes for the substituted updated structure grids in the stored existing models.

* * * * *